US005157882A

United States Patent [19]

Soble

[11] Patent Number: 5,157,882

[45] Date of Patent: Oct. 27, 1992

[54] POLE SUPPORT SYSTEM FOR A CARPORT AND THE LIKE

[76] Inventor: Bernard D. Soble, 16191 W. 11 Mile, Apt 106, Southfield, Mich. 48076

[21] Appl. No.: 515,215

[22] Filed: Apr. 27, 1990

[51] Int. Cl.[5] ..... E04D 15/00

[52] U.S. Cl. ..... 52/298; 52/297; 52/296; 52/165; 403/61; 403/116

[58] Field of Search ..... 52/165, 296, 297, 298, 52/721; 403/116, 61; 248/357

[56] References Cited

U.S. PATENT DOCUMENTS

| | | | |
|---|---|---|---|
| 877,268 | 1/1908 | Van Buren | 52/165 |
| 1,210,111 | 12/1916 | Smith | 52/298 |
| 1,730,754 | 10/1929 | Bensley | 52/296 |
| 2,735,702 | 2/1956 | Larson | 403/61 |
| 2,838,353 | 6/1958 | Emmert | 403/61 |
| 4,030,378 | 6/1977 | Kroesser | 403/116 |
| 4,125,975 | 11/1978 | Soble | 52/297 |

FOREIGN PATENT DOCUMENTS

| | | | |
|---|---|---|---|
| 2030613 | 4/1980 | United Kingdom | 52/165 |

*Primary Examiner*—David A. Scherbel
*Assistant Examiner*—Wynn E. Wood
*Attorney, Agent, or Firm*—Krass & Young

[57] ABSTRACT

A pole support system for a carport and the like includes an anchor member for the carport having an earth piercing bottom end for being pounded into the ground with a base ring positioned on the surface of the hard top and a spacer ring interposed between the base disc and stop collar at the top end of the anchor. A pole support has the second stop collar above its first lower end which telescopically engages the open top end of the anchor member. The upper end of the pole support has two spaced parallel flanges which are secured to a saddle member that is affixed to a beam at a variety of adjusted pivoted positions. Alternatively the top of the pole support can be mounted to two support plates which are horizontally disposed and can be adjusted along two horizontal axes and secured to each other at the desired position.

11 Claims, 4 Drawing Sheets

POLE SUPPORT SYSTEM FOR A CARPORT AND THE LIKE

TECHNICAL FIELD

This invention relates to pole structures and more particularly to carport structures mounted by poles embedded into the ground.

BACKGROUND OF THE INVENTION

Posts and poles have long been used to support structures. Commonly the pole is anchored to the ground a sufficient distance so it is able to bear weight.

However, many problems have existed with prior art support poles. Firstly, many require cement footings or other complicated anchoring devices. Often these footings require excavation of a relatively large hole which requires that the ground be exposed. Therefore, these footings are not suitable for use with preexisting asphalt or other hard top driveways or other road surfaces where the ground is not exposed. Existing methods now require large areas of black top to be first broken to expose the earth and create a cavity into the earth, thereby introducing moisture.

Secondly, support poles are usually secured directly to a load structure and therefore must be precisely positioned in the ground. Any manufacturing tolerances or deviations from specification between the pole and the support are often not addressed. An adjustment mechanism to provide a roof support for a carport and the like often needs an adjustment mechanism for either the cant of the roof or the translational lateral position of the roof with respect to the load bearing pole support.

What is needed is an easily assembled pole support system that can be securely anchored into the ground through asphalt or other similar road surface and can be secured to the roof support beams. What is also needed is a support system for previously thought to be unbuildable soils and marginally buildable soils that is applied into virgin earth by impacting beyond desired depth to attain traction, compression, and acceptable compaction which are known to remain constant in the earth to support structures up to a certain weight having various configurations, all without displacement of separation of the anchor from the soil, excavation of the soil, and use of the cement.

SUMMARY OF THE INVENTION

In accordance with the invention, a support pole mounting system includes a tubular anchor member preferably made from steel that has an earth piercing bottom end. Preferably the bottom end is shaped to form a blade or edge or alternatively is folded together to form a convoluted earth piercing end. The anchor member has a top end having a stop collar fixedly mounted thereto. The top end is open to telescopically receive a pole support member therein. A spacer ring is slidably mounted about the anchor member under the stop collar and is sized to abut the stop collar. Preferably an annular disc shaped base ring is slidably mounted under the spacer ring. The anchor member is pounded into the ground through a hole in an asphalt or similar hard surface. The hole is preferably sized slightly larger than the tubular member. The anchor member extends into the ground so that the stop collar, spacer ring, and base ring abut against each other and the base ring abuts the hard top.

A support pole member preferably made from tubular steel has a lower end section that is telescopically slidable in the open top end of the anchor member and has a stop collar fixedly mounted at a position spaced above the first end section such that it abuts against the stop collar of the anchor member. The first end section provides adequate interfacing with the anchor to assure continuity with the anchor as a placement foundation column.

Preferably the top end of the support pole member has a pair of spaced apart upwardly and extending substantially parallel flanges. A beam seat member is securable to a beam and is sized to fit between the flanges. Fasteners preferably extends through slots, and holes of the beam seat member and the parallel flanges to allow the beam seat member to be pivotally mounted at adjustable positions with respect to the parallel flanges.

Alternatively it is desirable that the support pole member has its top section adapted to telescopically receive a pole section that is affixed to a flat plate member. This flat plate member is horizontally disposed. A second flat mounting plate is adjustably affixed along two horizontal axes with respect to the first plate. An adjusting mechanism secures the second plate to the first plate at the desired positions along the two horizontal axes. Preferably the adjusting mechanism includes an intermediate plate interposed between the first plate and second mounting plate. The intermediate plate is adjustably fixed to the first plate along a first axis and the second plate is adjustably fixed to the intermediate plate along a second axis. Preferably the first and second axes are transverse to each other.

It is also desirable that a spacer block is interposed between the intermediate plate and one of the first and second plates to allow space for mounting and operation of the fasteners. Preferably the first plate has a pair of slots extending in one direction, the intermediate plate has two pairs of slots, each pair being transverse to the other. The second plate has a second pair of slots transverse to the pair of slots in the first plate. Preferably threaded fasteners and complementary nuts secure the intermediate plate to the first and second plates. The threaded fasteners extend through the pairs of slots to fasten the plates together.

In this fashion a support pole system has a narrow footing which does not need any concrete base or any excavation. The support pole member telescopically slides in the anchor pole to provide a quickly erected support pole system.

The top part of the support pole has an adjusting mechanism to attach a horizontal beam that is used commonly for flat roof designs as seen in carports and other similar structures. If the roof is misaligned or there is some other adjustment needed the support system at the top of the pole can accommodate such manufacturing deviations.

Alternately, if an angled carport roof is desired with an angled beam, the pole system can alternately include a saddle mechanism which will adapt for the angle of the beam without the need for the poles to be cut at an angle or any other cutting, drilling, welding and painting needed at the job site.

As such all manufacturing can be made at a factory or similar manufacturing site. Only the anchor members need to be pounded or anchored into the ground without augering the earth and use of cement to fill the cavity. The rest of the parts are merely assembled on site without cutting, drilling, welding and painting.

This technology is applied to a variety of applications where an anchor is in the earth, a support pole is interfaced with the anchor. The variety of applications may call for poles of different diameters, lengths and number of anchor members.

BRIEF DESCRIPTION OF THE DRAWINGS

Reference now is made to the accompanying drawings in which.

DETAILED DESCRIPTION OF THE PREFERRED EMBODIMENT

Figure 1:
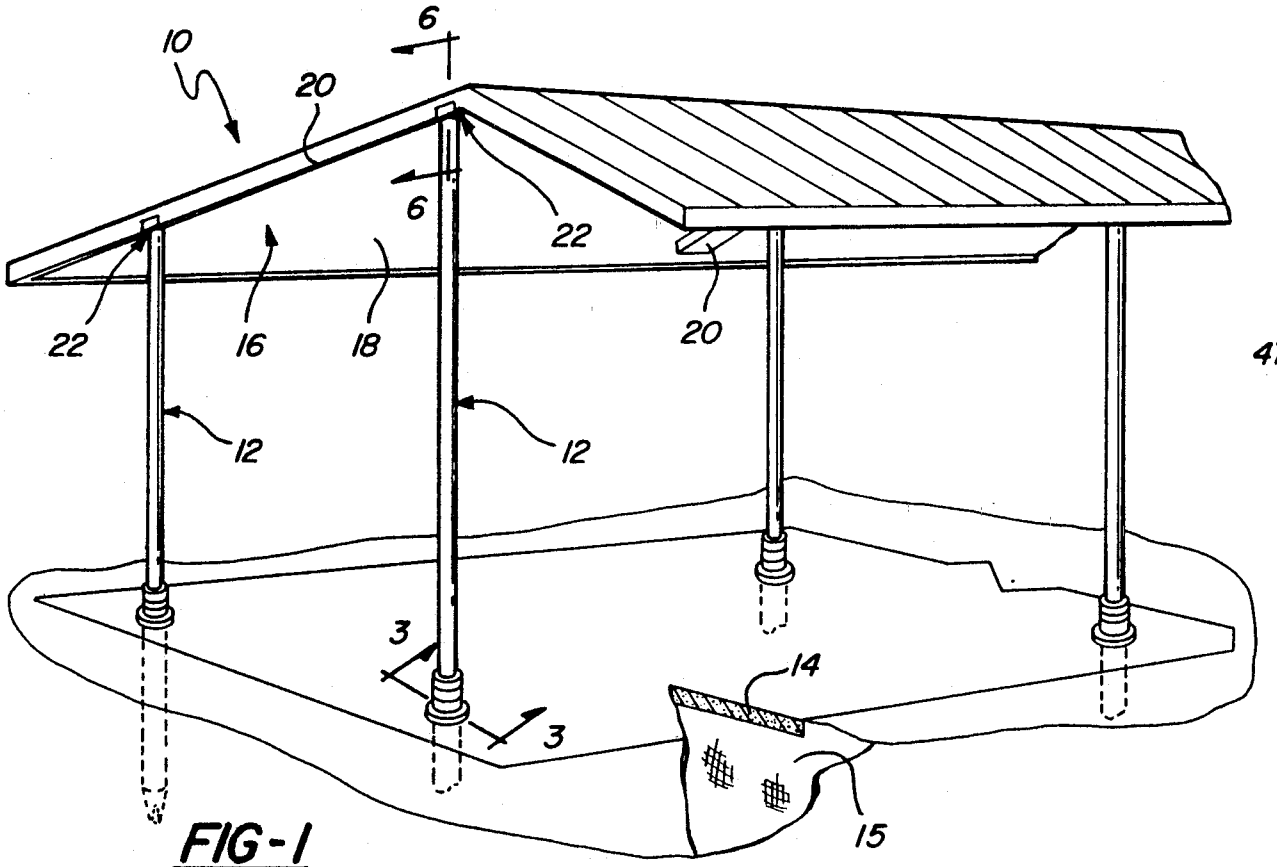
FIG. 1 is a perspective partially segmented view of a carport according to the invention.

Referring to FIG. 1, a carport assembly 10 generally includes a plurality of pole supports 12 secured into the ground 15 through an asphalt type or other hard surface 14. A roof assembly 16 comprises sheeting material 18 and a plurality of beams 20 secured to the top ends 22 of the pole supports 12. The roof assembly 16 has its sheeting material 18 and beams 20 positioned at an angle for design purposes.

Figure 2:
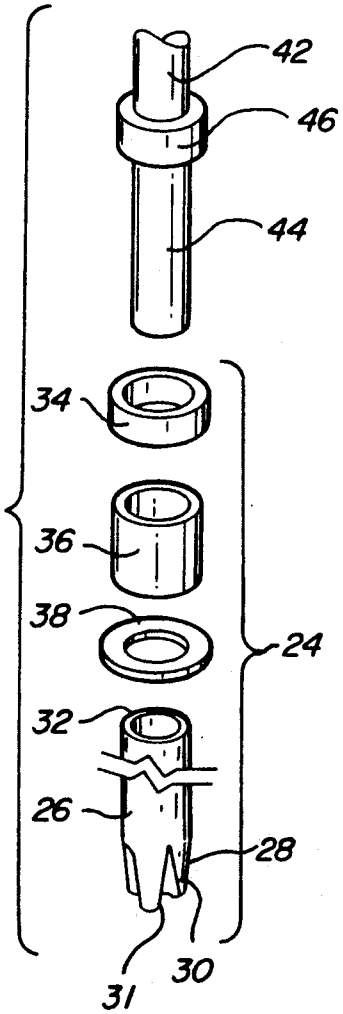
FIG. 2 is an enlarged exploded view of one of the footings shown in FIG. 1.
Figure 2B:
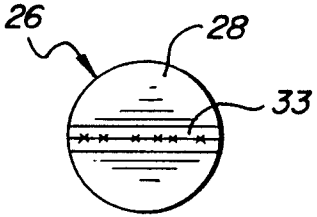
FIG. 2*b* is an enlarged end view of a second embodiment of the earth piercing end of the anchor member.
Figure 2A:
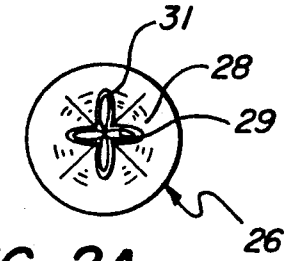
FIG. 2*a* is an enlarged end view of the anchor member disclosing the earth piercing end.
Figure 3:
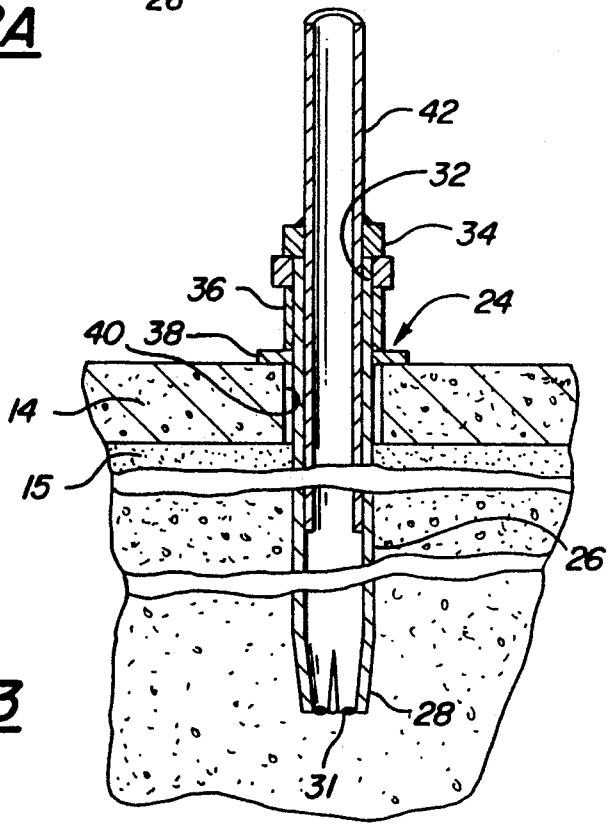
FIG. 3 is an enlarged cross sectional view of one of the footings taken along line 3—3 shown in FIG. 1.

Each pole support 12 is the same in construction with the only difference between them in their respective length or height of the top section 22. As such only one pole support system 12 will be referred to in FIGS. 2 and 3. As shown in FIG. 2 each pole support 12 includes a footing section 24. The footing 24 includes an anchor member 26 that has an earth piercing end 28. The earth piercing end 28 may be the tubular section flattened to a blade 33 and welded shut as shown in FIG. 2*b*. Alternatively the bottom end of the tubular section may be convoluted to form an earth piercing end 30 as more clearly shown in FIG. 2*a* that has four intersecting flanges 29. In either embodiment, the bottom edges 31 are welded shut as shown in FIG. 3. The tubular anchor member 26 may have varying lengths depending upon the soil conditions and weight of the supported loads. A typical length extending into ground of normal density and other conditions would be approximately four feet.

The top end 32 of the anchor member 26 has a stop collar 34 welded thereon. Below the stop collar is a spacer ring 36 which is slidably mounted onto the anchor member 26. Below the spacer ring 36 is a base disc 38 which is similarly slidably mounted onto the anchor member 26. Once the spacer ring 36 and base disc 38 are slidably mounted onto end 28, the anchor member 26 is then placed in position over a hole 40 through the hard top 14 which has been previously drilled or punched formed. The hole 40 needs only to be large enough to slidably receive the anchor member 26 and is smaller than the diameter of base disc 38. The anchor member is then pounded into the ground 15. The earth piercing end 28 drives the ground 15 apart. The surrounding ground 15 undergoes compaction and compression as the anchor member 26 intrudes into the ground 15. Rebounding of the earth against the anchor member provides for tractional engagement which prevents the anchor member from being easily pulled out of its footing 24. The anchor member 26 is pounded into the ground until the disc 38, spacer ring 36 and the stop collar 34 abut each other and disc 38 is against hard top 14.

A support pole member 42 has a stop collar 46 welded onto the pole 42 spaced from lower end 44. The lower end 44 is inserted in the open top end 32 of anchor member 26 and is telescopically received in the anchor member 26 until the stop collar 46 abuts top end 32 and collar 34. Typically the collar 46 is spaced approximately 15 to 18 inches from end 44. The support pole 42 can have varying lengths depending on the desired height of the beam 20.

Alternatively to the flush contact between pole 42 and pole 26, magnetic strips can be interposed between the two poles to help seat pole 42 in pole 26.

Figure 4:
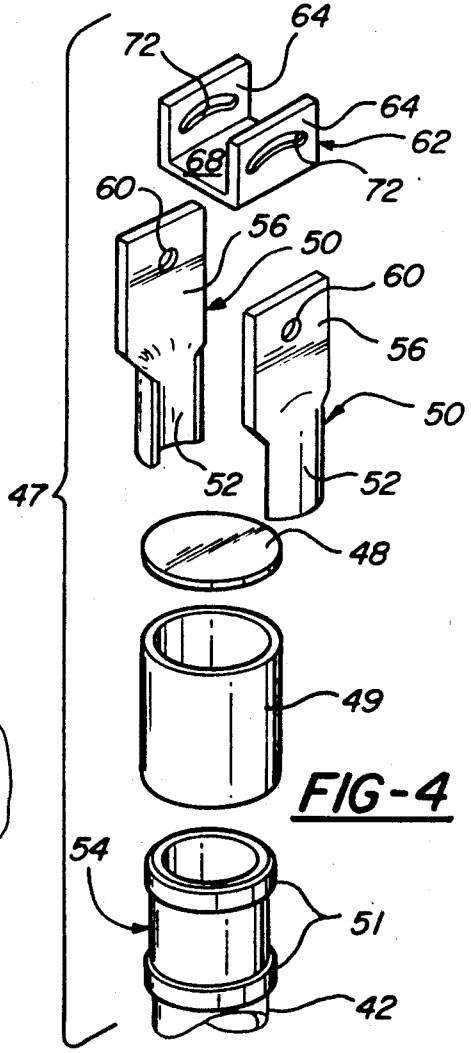
FIG. 4 is an exploded view of the upper section of the support pole shown in FIG. 1.
Figure 7:
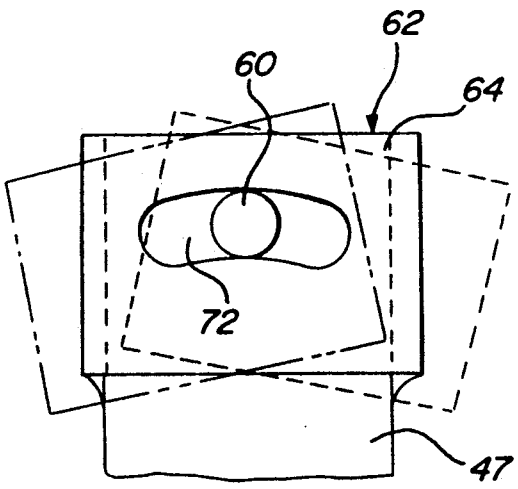
FIG. 7 is a schematic view showing the pivotal adjustment available with the top section shown in FIG. 4.
Figure 6:
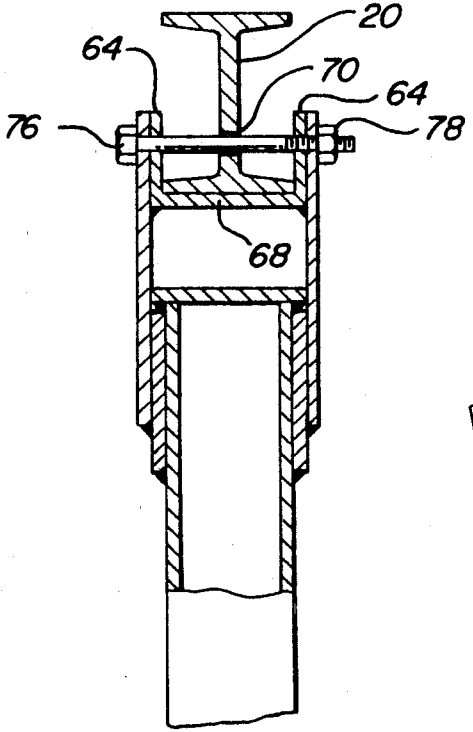
FIG. 6 is an enlarged cross-sectional view of the top part of the support pole taken along line 6—6 shown in FIG. 1.
Figure 5:
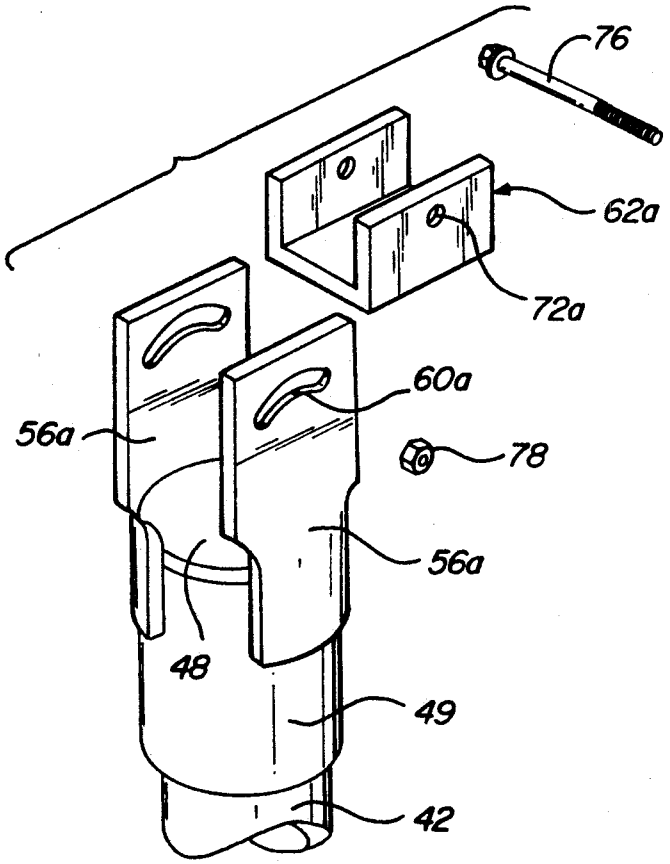
FIG. 5 is a partially assembled view of the upper section modified from the one shown in FIG. 4.

As shown in FIG. 4, the top section 47 of support pole 42 has a cap 48 welded onto a cap tube 49 which is welded onto pole 42 to seal the pole 42 and prevent water from entering the interior of the pole 42. Two magnetic rings 51 may be placed about pole 42 to initially position tube 49. Two flanges 50 having arcuate lower sections 52 are mounted about the exterior cap tube 49 and are welded thereon. Each flange 50 has a flat upwardly extending plate section 56 with a slot 60 extending therethrough. A beam support saddle 62 has two side walls 64 spaced apart sufficiently to receive I-beam 20 therein. The beam 20 rests on bottom wall 68 of saddle 62 and is welded thereto. The beam 20 has a crescent opening 70 therein which is aligned with the crescent openings 72 in the side walls 64. The support saddle 62 can fit within the space 74 between the flanges 56. A bolt 76 extends through the aperture 60, 72 and 70 and a nut 78 secures the other side of the bolt to fasten the beam 20, saddle 62 and pole 42 together in a desired canted or angled position. As shown in FIG. 7, the crescent slots 70 and 72 provide for adjustment of the beam relative to the pole. The slots 70 and 72 can alternately be shaped as horizontal linear slots, crosses, or other shapes depending upon the adjustment needed between the pole 32 and support beam 20. As shown in FIG. 5, slots 60*a* are in flanges 56*a* and saddle 62*a* has circular apertures 72*a* therethrough.

Figure 9:
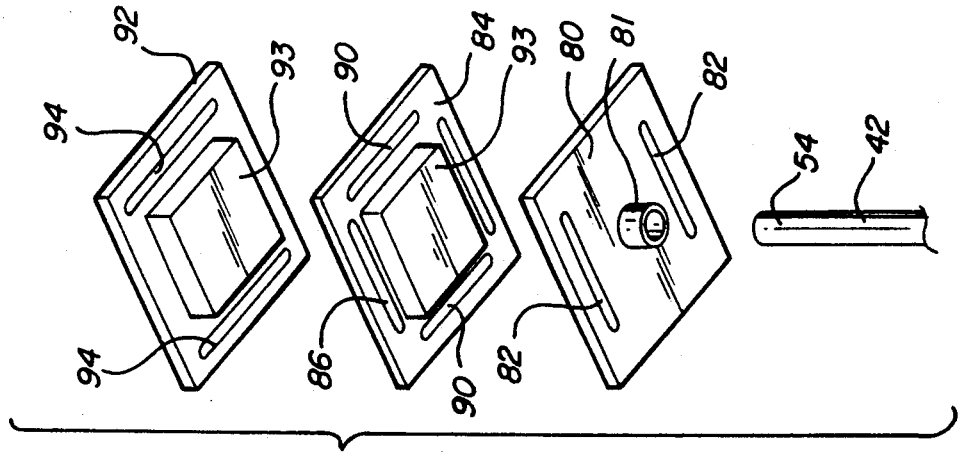
FIG. 9 is an exploded view of the upper end of the support pole assembly shown in FIG. 8.
Figure 8:
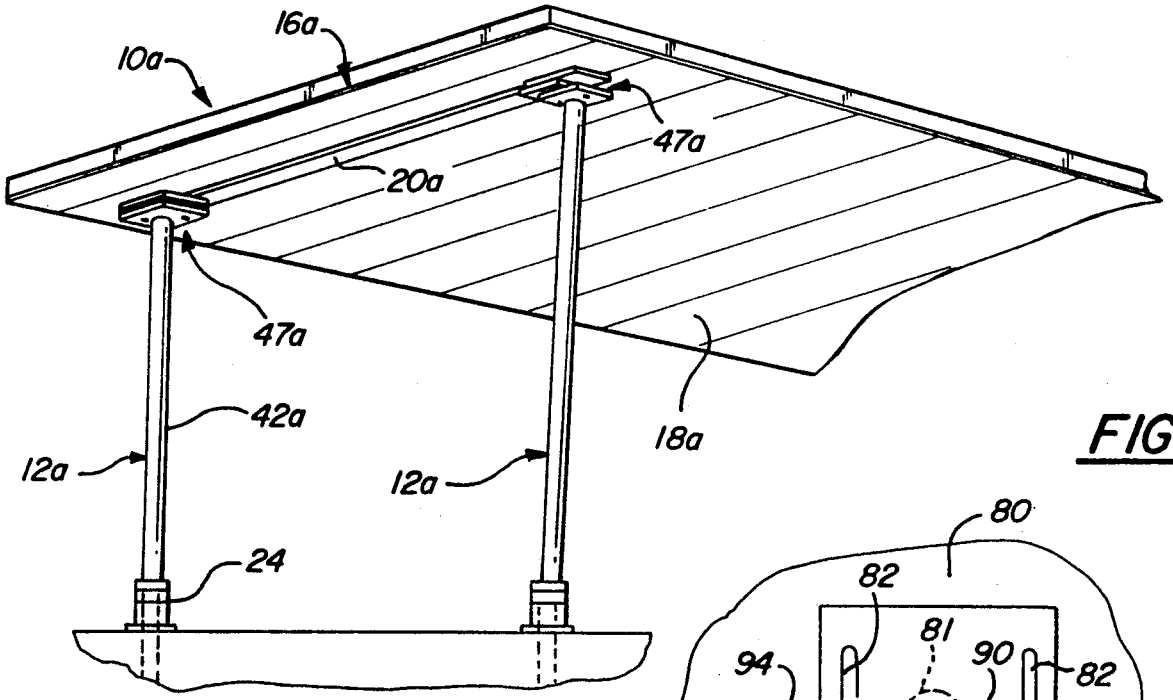
FIG. 8 is a perspective view of an alternate embodiment of a carport according to the invention.
Figure 10:
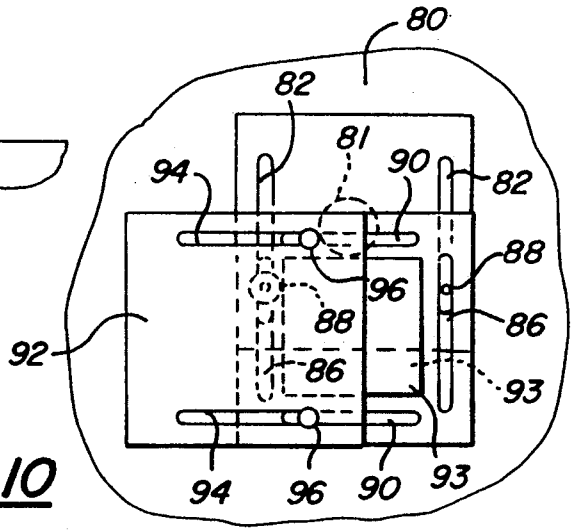
FIG. 10 is a top plan view of the upper end of the support pole shown in FIG. 8 illustrating an adjusted position.

When a carport 10*a* with a horizontal flat roof 16*a* is constructed there is more concern with the adjustment along the horizontal axes between the beams 20*a* and the pole supports 12*a* than with the vertical angle. A second embodiment as shown in FIG. 8 is used with carport 10*a* that has a flat roof 16*a* with horizontal beams 20*a*. The top section 47*a* of poles 42*a* is modified accordingly. As shown in FIG. 9, a first plate 80 is welded to a pole section 82 which slidably or telescopically fits in the top end 54 of pole 42. Plate 80 has a pair of parallel slots 82 sized to receive a fastener. A second plate 92 is mounted above the first plate and has a pair of slots 94 transverse to slots 82. An intermediate plate 84 also includes a pair of slots 86 alignable with slots 82. Fasteners 88 affix the intermediate plate to the first plate 80 by extending through the pairs of slots 82 and 86 and being tightened. The intermediate plate 84 has a second pair of parallel slots 90 that are transverse to the first pair of slots 86 and alignable with slots 94. Spacer plates or blocks 93 are interposed between the intermediate plate 84, the first plate 80 and second plate 92 and is sized to be within the domain of the space on the intermediate plate within the periphery defined by the two pairs of slots 86 and 90. Plates 93 are preferably made of Teflon. Alternately, blocks 93 can be integrally formed with plate 84 if desired and Teflon coated. Fasteners 96 extend through the second pair of slots 94 to affix the second plate relative to the intermediate plate 84. The horizontal plates 80, 84 and 92 are adjustable along two transverse horizontal axes and provide for any translational manufacturer deviations from specification between the roof beams 20*a* and pole supports 12*a*. The second plate 92 is mounted to the beam 20*a* via welding or similar affixation process.

In this fashion a carport is easily constructed and provides for mounting of the carport on a previously existing hard top and also allows for manufacturing tolerances for the precise position of the beams even if the poles 12 are slightly misplaced within the deviations set forth above. In addition, the matrix of pole supports can be easily built at a fixed location so that the carport can be built on site without welding or cutting of the beam members or pole support members. Furthermore, the poles need not be cut at an angle to provide for the desired canted roof line. Furthermore, the anchor system provides for a sufficient anchoring of the pole supports due to the earth piercing end of the anchor and the compaction and compression of the surrounding earth about the anchor member. Furthermore, the pole supports can be mounted on preexisting hard top through a hole that is drilled into the hard top without the need for excavation of the soil under the hard top or the pouring of concrete footings.

Variations and modifications of the present invention are possible without departing from the scope and spirit as defined in the appended claims.

I claim:

1. A support pole mounting system characterized by:

a tubular anchor member having an open top end and a bottom end;

an earth piercing means disposed at bottom end thereof;

an annular disc shaped base ring slidably mounted about said tubular anchor member;

a spacer ring slidably mounted about said tubular anchor member above said annular base ring;

a stop collar fixedly mounted about said open top end of said tubular anchor member;

a pole member having a first end section telescopically slidable in said open top end of said tubular anchor member and a second stop collar fixedly mounted at a position spaced above said first end section and abuttable against one of said top end and said stop collar of said tubular anchor member.

2. A support pole mounting system as defined in claim 1 further characterized by:

said earth piercing means being formed by welding together opposite edges of said tubular member at said bottom end to form a blade.

3. A support pole mounting system as defined in claim 1 further characterized by:

said earth piercing means being formed by folding said tubular member in convolutions to form at least three intersecting flanges.

4. A support pole mounting system as defined in claim 1 further characterized by:

said pole member having a sealed top section;

a pair of substantially parallel flanges spaced apart and affixed to said pole member, said flanges extending upwardly beyond said top section;

a beam seat member securable to a beam and sized to fit between said flanges;

a fastening means for fixedly securing said pair of flanges and said beam seat member together at a plurality of vertical angular positions.

5. A support pole mounting system having a section anchored into ground, said system characterized by:

an elongated tubular anchor member having an earth piercing means at a bottom end thereof for allowing said anchor member to be hammered into the ground and a radially outwardly extending stop shoulder means at a top end thereof;

a pole member having a first end section telescopically slidable in said anchor member, said pole member having radially outwardly extending collar means fixedly mounted on an outer wall thereof spaced above said first end section and abuttable against said stop shoulder means of said anchor for supporting said pole member on said anchor member.

6. A support pole mounting system defined in claim 5 further characterized by:

a spacer ring member mounted about said anchor member and interposed between said top end and said ground when said anchor member is anchored into the ground.

7. A support pole mounting system as defined in claim 6 further characterized by:

an annular disc shaped base ring mounted about said anchor member and interposed between said spacer ring and said ground for distributing downward forces on said spacer.

8. A support pole mounting system characterized by:

a support pole member;

a top section of said pole member having a sealing cap affixed thereto;

a pair of substantially parallel flanges spaced apart and affixed to said pole member with the flanges extending upwardly beyond the top section of said pole member;

a beam seat member securable to a beam and sized to fit between flanges;

fastening means for fixedly securing said pair of flanges and said beam seat member together at a plurality of vertical angular positions.

9. A support pole mounting system as defined in claim 8 further characterized by:

said beam support member being generally U-shaped and being sized to receive a beam at an open top thereof.

10. A support pole mounting system as defined in claim 8 further characterized by:

said flanges each have a lower section having an arcuate contour constructed to flushly abut said top section of said pole member.

11. A support pole mounting system as defined in claim 8 further characterized by:

said fastening means includes apertures through said flanges and said beam support member and sized to receive a fastener assembly that fixedly secures said flanges and said beam support member together.

* * * * *